United States Patent [19]

Rohan et al.

[11] 4,255,745

[45] * Mar. 10, 1981

[54] APPARATUS FOR AUDIBLE ALTERING OF ENCLOSURE OPENING

[76] Inventors: Joseph J. Rohan, 841 Amolac, St. Louis County, Mo. 63141; Gregory W. Kuehl, 4079 Calvera, St. Louis County, Mo. 63134

[ * ] Notice: The portion of the term of this patent subsequent to May 15, 1996, has been disclaimed.

[21] Appl. No.: 31,051

[22] Filed: Apr. 18, 1979

Related U.S. Application Data

[63] Continuation-in-part of Ser. No. 785,309, Apr. 6, 1977, Pat. No. 4,155,077.

[51] Int. Cl.[3] ..... G08B 13/08

[52] U.S. Cl. ..... 340/546; 340/384 E; 340/309.1; 340/600

[58] Field of Search ..... 340/692, 384 E, 546, 340/555, 600, 309.1; 307/208, 214; 128/746

[56] References Cited

U.S. PATENT DOCUMENTS

| | | | |
|---|---|---|---|
| 3,683,346 | 8/1972 | Horton | 340/384 E |
| 3,922,672 | 11/1975 | Birt et al. | 340/384 E |
| 4,086,589 | 4/1978 | Cieslak et al. | 340/384 E |
| 4,155,077 | 5/1979 | Rohan et al. | 340/600 |

*Primary Examiner*—Glen R. Swann, III
*Attorney, Agent, or Firm*—Kalish & Gilster

[57] ABSTRACT

A portable, miniaturized, self-contained audible alerting device is disclosed. The device is housed in a small case adapted to be positioned in a darkened enclosure, such as a medicine cabinet, for receiving light when the enclosure is opened, producing an audible signal after a predetermined time delay for altering a person some distance from the enclosure that the latter has been opened, e.g., by a child. Within the case is a photodetector positioned with respect to an aperture of the case which receives light upon opening of the enclosure. Also within the case is a time delay circuit responsive to the photodetector, a first oscillator controlled by the time delay circuit, an amplifier circuit and a transducer, for providing the audible alerting signal only after the time delay. A frequency control circuit, comprising a lower frequency oscillator, causes an output signal of the first oscillator to change repeatedly between upper and lower frequency limits. The time delay prevents the alerting signal from being given if the enclosure is opened and then closed quickly enough by a person knowing of the device, e.g., the parent of the child. The upper and lower frequency limits are such that the signal can be heard even by persons having frequency impaired hearing.

12 Claims, 9 Drawing Figures

APPARATUS FOR AUDIBLE ALTERING OF ENCLOSURE OPENING

CROSS-REFERENCE TO RELATED APPLICATION

This application is a continuation-in-part of the application of Joseph J. Rohan et al, Ser. No. 785,309, filed Apr. 6, 1977, now U.S. Pat. No. 4,155,077.

BACKGROUND OF THE INVENTION

The invention relates to devices for audibly signalling or alerting in response to light and, more particularly, to self-contained, portable devices of such character which are responsive to receiving light upon the occurrence of an event to be detected.

Within a typical household where there are young children, a medicine cabinet and other normally darkened enclosures having easily opened doors are typically used for storage of medicines, drugs and other poisonous or potentially dangerous substances or items.

It is often desirable for a parent or other person responsible for such a child in this kind of an environment to know if the child should open an enclosure containing a substance or other item which could be injurious to the child.

However, it is often difficult, if not impossible, to closely monitor the activities of a normally inquisitive child within the home. Accordingly, to prevent a child from opening an unlocked enclosure containing potentially injurious substances or items is not practically attainable.

Of course, it would be possible to install burglar alarm-type sensors, such as door-operated switches wired to an alarm, but this is usually prohibitively complex and expensive.

One difficulty in utilizing an audible alerting signal for warning persons in these situations is that the signal must be heard at a considerable distance from the guarded location and desirably should command one's attention as well as be capable of being heard by those having impaired hearing.

SUMMARY OF THE INVENTION

It is an object of the present invention to provide an audible laerting apparatus constituting a device which can be placed in a normally darkened enclosure and useful for audibly alerting a person some distance from the enclosure when the enclosure is opened.

It is a further object of the present invention to provide a device of the foregoing character which provides such audible alerting only after a predetermined time delay period following opening of the enclosure.

Another object of the invention is to provide a device of the foregoing character which is portable, miniaturized, self-contained and which also is extremely simple to use, is of relatively simple construction, and is reliable and long-lasting in use.

A still further object of the invention is to provide a device of the foregoing character which generates an audible alerting signal of a very attention commanding nature.

Yet another object of the invention is to provide a device of the foregoing character which provides an audible alerting signal which can be heard by persons with frequency impaired hearing.

Other objects and features will be apparent or are pointed out in the description which follows.

BRIEF DESCRIPTION OF THE DRAWINGS

Corresponding reference characters indicate corresponding elements in the several figures of the drawings.

DESCRIPTION OF THE PREFERRED EMBODIMENTS

Figure 1:
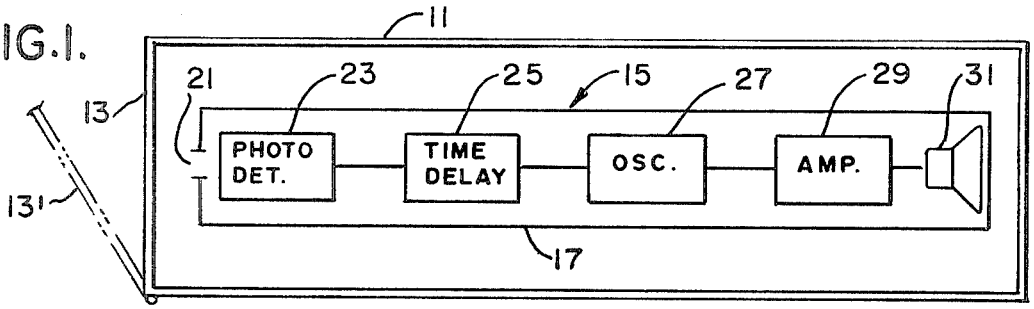
FIG. 1 is a simplified block diagram of a first embodiment of the invention.

Referring to FIG. 1, designated 11 is an enclosure of such as a medicine cabinet, which is normally darkened when a door 13 or other usual closure is in the closed position shown. When the door is opened as shown at 13', light is permitted to enter enclosure 11.

It will be understood, of course, that enclosure may be of virtually any size, shape and configuration so long as it is of sufficient volume to house an audible alerting apparatus, i.e., the device of the present invention. As shown in FIG. 1, within enclosure 11 has been placed a device of the present invention. The device is designated generally at 15. Device 15 includes a small case 17, e.g., of plastic or metal, suitably shaped for enclosing all of the circuit elements of the device and a battery for powering such circuitry, all as later described.

Figure 2:
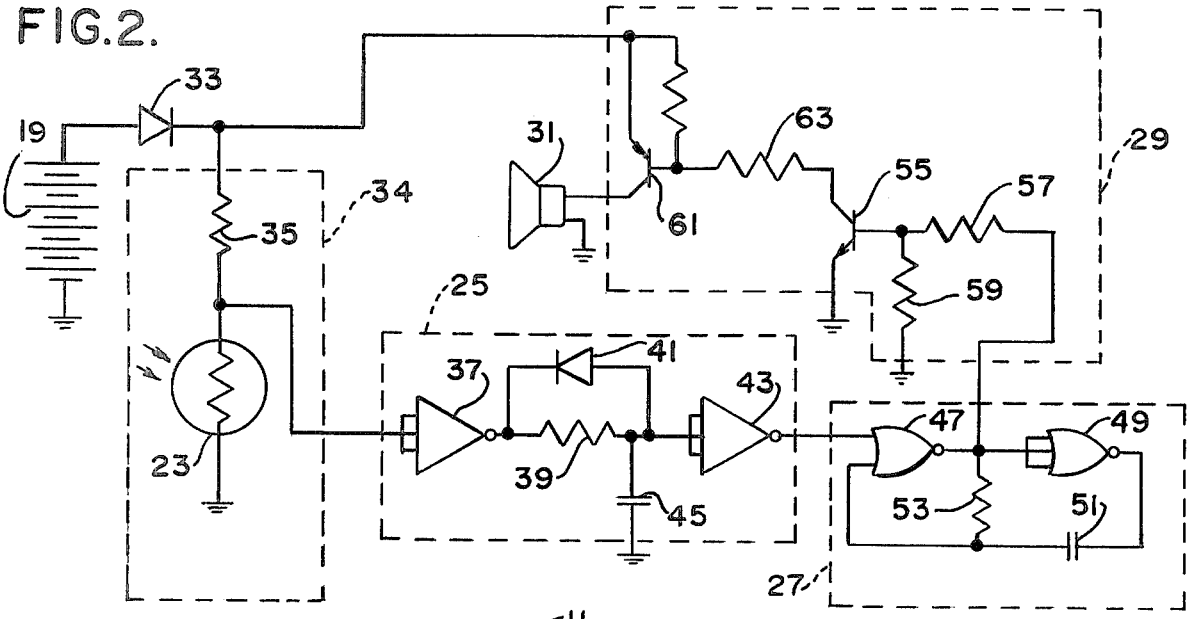
FIG. 2 is a schematic circuit diagram of the embodiment of FIG. 1.

The battery, e.g., a 9-volt transistor radio type, is designated at 19 in FIG. 2, but is not shown in FIG. 1 in the interest of simplicity. Other elements of the embodiment of device 15 are shown in FIG. 1 in block form, however.

At 21 is shown an aperture of case 17. While the aperture may be simply an opening in the case, it may also comprise a lens in the sense that a lens may be said to have an aperture, or may simply be some area on the surface of case 17 for receiving light from outside enclosure 11 when the latter is opened. In any event, a photodetector 23 is positioned within case 17 with respect to aperture 21 for detecting light received by the aperture. The photodetector provides a first signal in response to the detected light to a time delay circuit 25 within the case.

Time delay circuit 25 provides a time-delayed second signal in response to the first signal after a predetermined period following the providing of the first signal.

This second signal is supplied to an oscillator circuit 27 within the case for providing an oscillating signal in response to the time-delayed second signal. This oscillating signal is amplified by an amplifying circuit 29 within the case and, as sufficiently amplified, is delivered to a transducer 31, such as a small loudspeaker in the case to provide an audible alerting signal which will be audible to a person outside enclosure 11 and well removed or distant therefrom, e.g., in another room.

As illustrated, device 15 is positioned within enclosure 11 for permitting light from outside the enclosure to be received by aperture 21 when the enclosure is opened by movement of the door 13 to the open position 13'. Accordingly, if the enclosure is a medicine cabinet, for example, which is opened by a small child, a parent will be alerted after the predetermined time delay period by the audible signal.

FIG. 2 shows the overall circuitry of the FIG. 1 embodiment. Battery 19 supplies a suitable potential through a diode 33 to a circuit 34 including photocell 23. Hence, a current flows through a resistor 35 to photocell 23, here shown as being of a photosensitive type. As will be understood, the resistance of the photocell changes in response to light detected by the cell, thereby producing a change in voltage across the cell constituting said first signal.

Time delay circuit 25 comprises a first logic inverting gate 37 having its output terminals connected to the high side of photocell 23. A resistor 39 (e.g., of 1 megohm) and diode 41 in parallel therewith interconnect the output of gate 37 with the inputs of a second such gate 43. A capacitor 45 (e.g., of 10 microfarad) is connected between the inputs of gate 43 and ground so that with resistor 39 there is provided a resistive-capacitive circuit providing at the output of gate 43 a time-delayed response to the first signal. Both gates 39 and 43 may be part of a commercially available integrated circuit such as type CD4001.

Oscillator circuit 27 comprises a 2-input logic NOR gate 47. One of its inputs receives the time-delay second signal. Its output is interconnected with the inputs of another logic NOR gate 49. The output of the latter is interconnected by a capacitor 51 (e.g., of 0.1 microfarad) to the other input of NOR gate 47. There is a resistor 53 (e.g., of 27 kilo ohms) between the output of the first gate 47 and the latter input thereof. Accordingly, the output of gate 47 supplies an oscillating signal at a suitable audio frequency (e.g., several hundred hertz) to the amplifier circuit 29.

Like the logic gates of time delay circuit 25, the NOR gates of oscillator circuit 27 may be in the form of a conventional commercially available integrated circuit type like the type CD4001.

Amplifier circuit 29 comprises a NPN transistor 55 such as type 2N3415 whose base receives the oscillatory signal via a voltage divider pair of resistors 57 and 59. Its collector drives the base of a PNP transistor 61, Its collector drives the base of a PNP transistor 61, such as type D29E6, through a resistor 63 to provide an amplified audio signal from the collector of transistor 61 to loudspeaker 31 which is, of course, responsive to the amplified oscillating signal.

Figure 4:
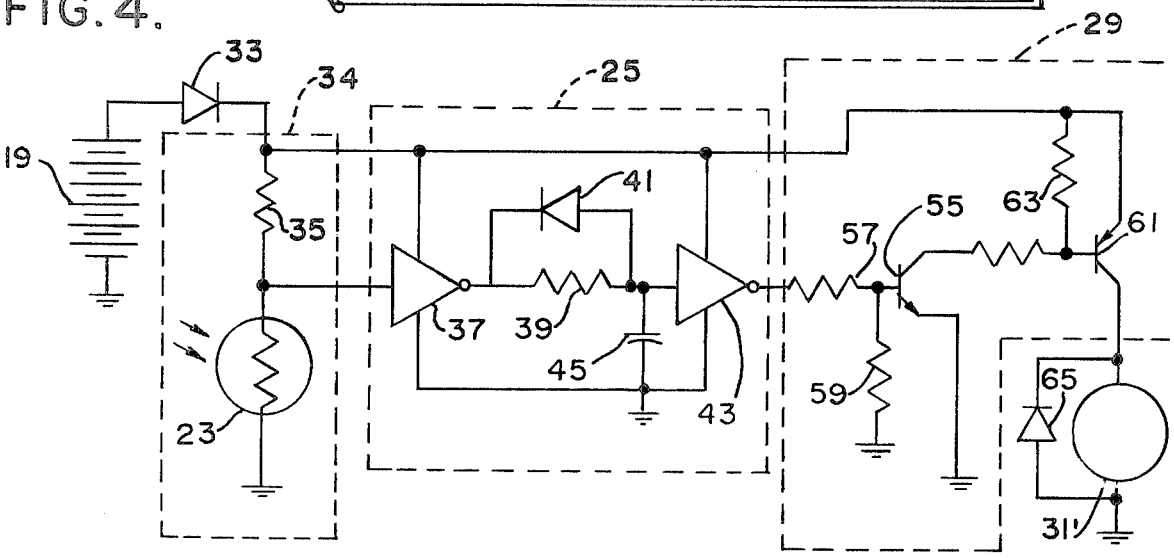
FIG. 4 is a schematic circuit diagram of the embodiment of FIG. 3.

The various usual power leads which supply voltage from battery 19 to gates 37, 43, 47 and 49 are not shown in the interest of simplifying FIG. 2. Representative power connections are, however, shown in the circuit of FIG. 4.

Figure 3:
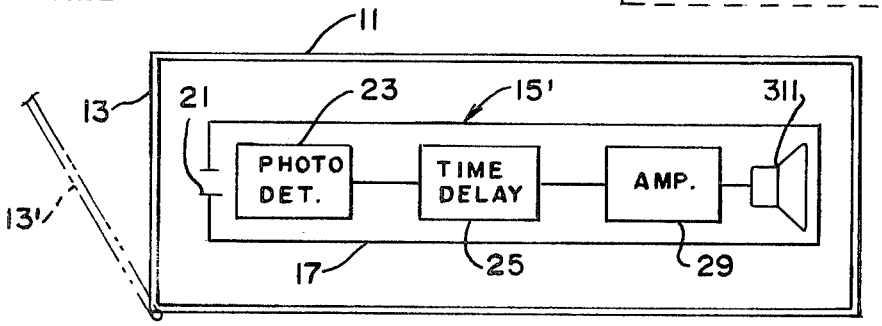
FIG. 3 is a simplified block diagram of a second embodiment of the invention.

A simpler embodiment of the invention is shown in block form in FIG. 3 and is designated generally 15'. It has a similar or identical case 17 having elements 23,25, 29 and a transducer 31' of the type responsive to a d.c. signal of sufficiently amplifier magnitude. For example, it may be a buzzer-type transducer such as the commercially available type sold under the trademark "SONALERT". A diode 65 may be connected across such buzzer-type transducer 31' to protect transistor 61 from high reverse voltage peaks produced by the inductance of the transducer.

When integrated circuit devices of the type noted above are employed for the present device, it is practical for the case dimensions to be of very small rectangular size, e.g., with its greatest dimension not more than a couple of inches or so, with a thickness of an inch or so. Accordingly, the device is quite portable and miniaturized and, hence, may readily be placed in a medicene cabinet or other enclosure and even may be concealed easily.

The time delay feature permits a knowledgeable person, such as a parent, to quickly open the medicine cabinet and retrieve a familiar item and then close the door promptly without causing an audible signal to be given. However, a curious child is not so quickly purposeful in opening and then promptly closing the door to prevent a signal from being given.

The photocell used in the device is preferably responsive to a visible portion of the spectrum, such as about 500 nanometer, so that it will be responsive to the usually present sources of light such as sunlight, as well as fluorescent and incandescent sources.

CONTINUATION-IN-PART

Figure 5:
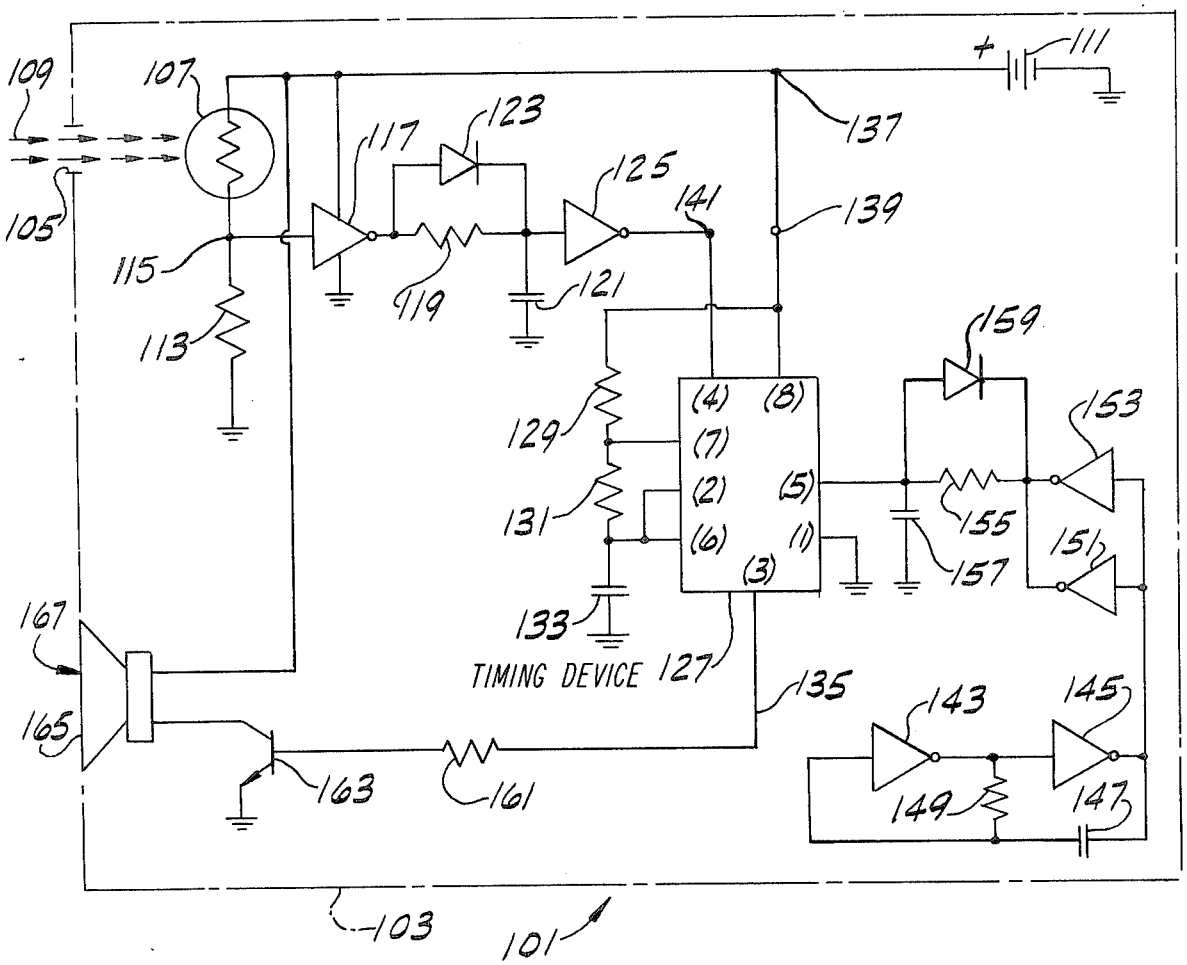
FIG. 5 is a schematic circuit diagram of a further embodiment of the invention constructed in accordance with and embodying circuitry disclosed in accordance with the continuation-in-part of the invention.

Referring to FIG. 5, there is indicated generally at 101 a modified further circuit embodiment of the new apparatus which provides a self-contained, portable device for being placed in a normally darkened enclosure and which is responsive to light upon opening of such enclosure for providing an audible alerting signal to be heard by a person at some distance from the enclosure.

The circuitry of FIG. 5 is suitable for being housed in a small case 103, e.g., metal or plastic of the same type and/or size as case 17 which houses the circuitry of FIG. 1. Similarly also, case 103 is provided with an aperture 105 therein, which may comprise an opening or lens, for admitting light to a photocell 107 similar to photodetector 23 upon light rays 109 resulting from the opening of a normally darkened enclosure, e.g., a medicine cabinet, drawer, tool box, cash box, etc., in which case 103 has been placed. Photocell 107 is of the photoresistive type exhibiting reduced resistance when light is incident thereupon.

As with previous embodiments, case 103 also contains a battery 111 for powering the circuitry of the new embodiment and such may be of the 9-volt transistor radio type. Certain solid state circuitry of the new embodiment is shown interconnected with battery 111 for purposes of illustration but other portions or devices of the circuitry which are, in fact, interconnected with battery 111 are not shown as having any interconnection with the battery in order to simplify the drawings, as it is quite well known how to connect the battery to such other portions or devices.

Photocell 107 is connected in series with a resistor 113 across battery 111 whereby an inaudible electronic signal, constituted by an increased voltage, is provided at a node 115 upon light being received by the photocell through aperture 105. Such signal is effectively amplified, in logic inverted form, by a logic inverting gate 117 in integrated circuit form, such as one gate of commercially available mitigrated circuit type CD4049 having six such logic inverting gates. Gate 117 is shown connected for being powered by battery 111 and it will be understood that other such gates of this circuit are similarly provided with a DC operating potential. The input of gate 117 is pulled high when light falls upon photocell 107 for causing the output.

The logic-inverted output of gate 117 is connected through a resistor 119 for discharging of a capacitor 121 for time delay purposes. A diode 123 interconnected across resistor 119 provides for quick charging of capacitor 121 if light is no longer received by photocell 107. Thus, the circuit provides a time-delayed response, dependent upon the time constant determined by the values of components 119,121, upon light being received by the photocell, but quick response if such light is no longer received, such as prompt closing of the medicine chest, drawer, etc. in which unit 101 is placed.

Interconnecting this time delay circuit with an oscillator circuit shortly to be described is a further logic inverting gate 125. The output of the latter goes high upon discharge of capacitor 121, which occurs after a predetermined period following the incidence of light upon photocell 107.

The oscillator circuit is provided by an integrated circuit timing device 127 such as commercially available type timing circuit NE555 having connected therewith an RC network comprising resistors 129,131 and a capacitor 133. Connection of these and other circuit components and leads to pins of device 127 is indicated by parenthetic notation of the pin numbers.

Such device 127, as herein connected, is adapted to oscillate at a center frequency controlled by the values of components 129, 131 and 133 when voltage for enabling oscillation is provided by the output of gate 125. Thus, device 127 will provide a signal at such frequency at an output, pin (3) of the device, to which a circuit lead 135 is connected. A DC voltage for causing operation of the device is provided at pin (8). For this purpose, power may be supplied either by a connection made from a node 137 to a terminal 139 directly to the battery 111 or by a connection between a node 141 to terminal 139. The choice of connection provides two different modes of operation described below. The values of components 129,131 and 133 may be chosen to give a center frequency at about the middle of the range of normal hearing (which typically is from less than about 100 Hz to about 10 KHz or slightly more). For example, the center frequency may be about 1,600 Hz.

A second oscillator circuit is interconnected with circuit device 127 by means of pin (5) thereof. This second circuit, which operates at a frequency much less than the above-noted center frequency, is constituted by a pair of logic inverter gates 143,145 having the output of the second logic gate interconnected through a capacitor 147 to the input of logic gate 143 to provide a feedback circuit for causing oscillation, there being also a resistor 149 connected between the output logic gate 143 and its input. Accordingly, there is provided at the output of logic gate 145 a square wave signal having a frequency determined by the values of components 147 and 149. The period of each cycle of oscillation may be typically one to three seconds.

A parallel connected pair 151,153 of the logic converter gates provide this square wave signal to an RC circuit including a resistor 155 and capacitor 157 which are seen to be connected in effect as an integrator for smoothing the square wave signals. The smoothed signals, which may be of generally sawtooth character having characteristic ramp-like portions, is applied to pin (5) of timing device 127 for modulating the output frequency of the latter.

As will be apparent, the smoothed periodic signal present across capacitor 157 constitutes a periodically varying voltage and the difference in the frequency provided on output lead 135 by timing device 127 from the center frequency is a function of this voltage. If desired, a diode 159 may be connected across resistor 155 for causing the periodic voltage characteristic to be asymmetric. Thus, depending upon the polarity of diode 159 (which may be opposite from that shown), the sawtooth characteristic may rise relatively slowly and then fall quickly or may instead rise quickly and fall slowly. Such diode will thereby alter the characteristic sound provided by the device of the present invention.

For the purpose of converting the electronic output signal present on lead 135 to an audible alerting signal, such lead is connected through a resistor 161 to an NPN transistor 163 having its emitter-collector terminals connected in series with a loudspeaker 165 or other suitable transducer across battery 111. Transistor 163 effectively amplifies the output signal provided on lead 135 and provides the amplified signal to the loudspeaker. Speaker 165 may be of the miniaturized type (such as approximately two inches in diameter) and such loudspeaker may be mounted within case 103 whereby a grill or other apertures in the region indicated at 167 are located over the speaker.

In accordance with the invention, the component values of the new circuit are selected so that the output frequency provided by timing device 127 and converted to an audible alerting signal will vary between upper and lower frequency limits which are typically within the above-noted normal human hearing range.

Preferably, the upper limit is sufficiently high for hearing by persons having low frequency impaired hearing and the lower limit is sufficiently low for persons having high frequency impaired hearing. Broadly, the preferred upper and lower frequency limits are within the range of about 100 to 8,000 hertz and specifically preferred ranges which have been found adequate by most persons, including those with impaired hearing at either high or low frequencies are about 2,500 hertz for the upper frequency limit and 800 hertz for the lower frequency limit.

Figure 6:
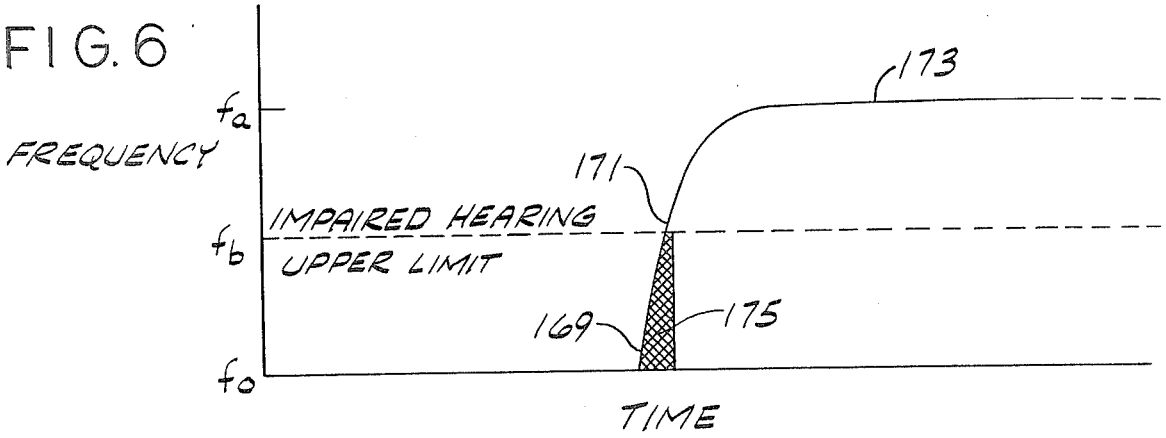
FIG. 6 is a plot of the frequency as a function of time, of an audible alerting signal of a prior device.

Referring to FIG. 6, previous embodiments providing alerting signals provided a frequency characteristic varying with time wherein, following a time delay after the device is switched on, the frequency starts at a relatively low value, as indicated at 169 and rises rapidly and exponentially as indicated at 171 until it reaches a constant upper frequency $f_a$, as shown at 173. Apparent intensity, to a normal hearing individual, is then unvarying and constant. Under same circumstances, such may not attract the attention of a person which is preoccupied with other matters and the sound at such fixed frequency may be masked by other noise producing apparatus such as motors, etc.

A further problem with such prior scheme is that persons having high frequency impaired hearing may be unable to hear or discern sounds above a frequency $f_b$. If the terminal frequency $f_a$ is greater than hearing frequency $f_b$, such person have heard a tone only for a brief duration, as indicated by the shaded region 175, when the device is first turned on. Thereafter, the person will further hear no sound.

In operation, the new device 101 is placed within an enclosure to be guarded, such as a medicine cabinet, drawer, cash box, tool box, etc., which is then closed to shut off light. The enclosure is thereafter opened, a time delay interval determined by values of resistor 119 and capacitor 121 ensues. At a time $t_1$ after such interval ($t_1$–$T_0$), the device begins oscillation at a frequency $f_1$ at a point 176 to provide a sawtooth voltage characteristic 177.

Figure 7:
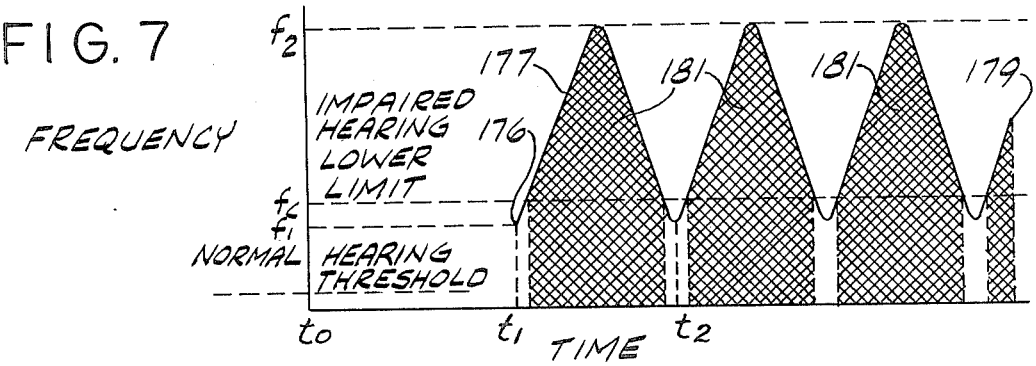
FIG. 7 is a plot of frequency, as a function of time, of an audible alerting signal of a device utilizing the circuitry of FIG. 5.

FIG. 7 illustrates a sawtooth-like frequency characteristic of the alerting signal of the present device. The frequency oscillates between a lower limit $f_1$ and upper limit $f_2$ over a period ($t_2$–$t_1$). Therefore, a person of normal hearing is provided with an audible alerted signal having a warbling or siren-like characteristic which is most commanding of one's attention.

When the enclosure containing the new embodiment 101 is closed so that light no longer falls upon photocell 107, diode 123 quickly terminates the signal permitting operation of timing device 127 for oscillator purposes. Therefore, the audible alerting signal provided by the new device is promptly terminated. This is representatively indicated at 179.

FIG. 7 also illustrates the advantages of the new device for a person having lower frequency impaired hearing. If such person is incapable of hearing sounds having a frequency lower than a value $f_c$, areas under the curve which are shaded, as indicated at 181, represent intervals during which such an individual may hear rising and falling audible alerting signals of the new device. During each such interval 181, the low frequency hearing impaired individual will hear an increase and then a decrease in the frequency of the audible alerting signal followed by a brief period of quietude. Such quiet period will then again be followed by a period of a rising and falling sound, such pattern repeating. Thus, not only will the frequency appear to vary for such individual but also there will apparently be an interrupted tone and such is most commanding of one's attention.

Figure 8:
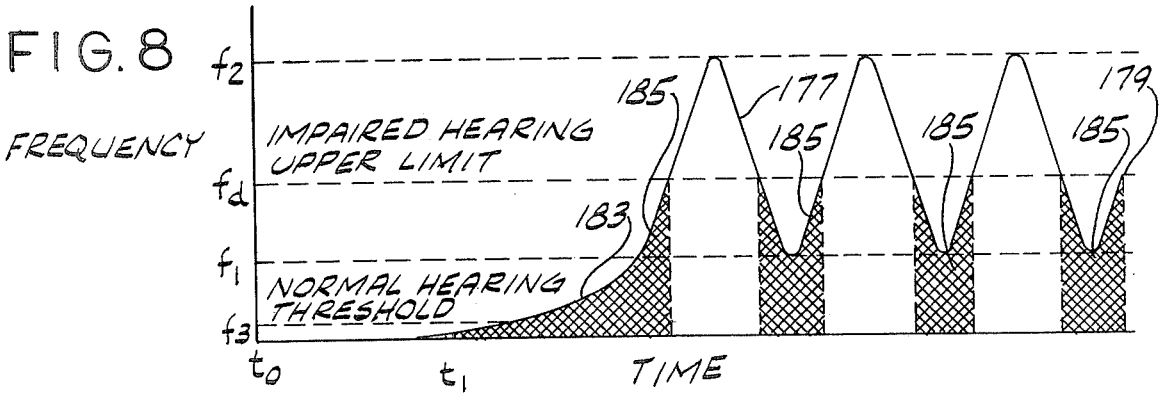
FIG. 8 is a plot similar to FIG. 7 but showing a modified frequency characteristic resulting from a modified configuration of the circuitry of FIG. 5.

FIG. 8 is illustrative of a further modification of the invention as previously noted involving the use of a circuit connection 141 for providing operating voltage for the oscillator circuit provided by timing device 127. When such connection is employed, rather than the connection 137 directly to the battery, operating potential for providing oscillation by timing device 127 is not present until the output of logic gate 125 goes high. Therefore, voltage for charging of capacitor 133 is not available until the initial time delay interval determined by capacitor 121 has elapsed.

Since capacitor 133 charges relatively slowly, the frequency of oscillation provided by timing device 127 is initially quite low with the result that the oscillation provided by timing device 127 begins at a very low frequency. Due to the size and frequency response of the small loudspeaker 165, the same is unable to provide useful frequency response below about 100 hertz. The audible alerting signal will begin at a time $t_1$ at a frequency which is substantially below that capable of being heard by a person of normal hearing and also at a quite low sound intensity due in part to inefficiency of the speaker at these low frequencies. As the output frequency rises above that capable of being reproduced by transducer 165, as indicated at frequency $f_3$, the device will be heard to produce increasing frequency sound as indicated by a characteristic 183 and such will then increase to frequency $f_1$ and thereafter will follow the sawtooth characteristic 177, as previously described.

The initial low intensity, low frequency sound has a distinct advantage when a device of the invention is utilized by a parent for guarding a medicine cabinet which a child might be prone to open. When the door to the medicine cabinet is opened and following the delay interval, the initial frequency of oscillation and intensity of the audible alerting signal is quite low, and hence is very gentle and unsurprising in character to avoid abruptly startling a child which otherwise might cause the child to be so frightened as to fall, for example, from a lavatory or chair, etc.

The initiation of sound is rather like the well-known "tsk-tsk-tsk" sound which a parent might be inclined to utter for warning a child not to open a medicine cabinet. But, once the sound has gone beyond this warning nature and reaches the sawtooth characteristic 177, the varying frequency and relatively loud intensity will alert a parent who may safely intervene and prevent the child from consuming any toxic substance, for example, that may be present in the medicine cabinet.

FIG. 8 is illustrative also of the advantage of the new device when it is desired that a person having high frequency impaired hearing be capable of receiving an audible alerting signal. Such person may have an upper frequency limit $f_d$ above which ordinary sounds are not well, if at all, heard, a rather commonly encountered hearing disability. The sawtooth frequency characteristic of the new device ensures that such individuals have intervals as those indicated 185 during which the device will be heard to provide an audible alerting signal which varies in frequency. Thus, such intervals will be characterized by sounds which appear to begin at the upper frequency hearing limit $f_d$ and fall to the lower frequency limit $f_1$ of the device and then again rise to the upper frequency hearing limit $f_d$. Thus, not only will the audible alerting signal appear to vary in frequency but also will be periodic in nature and thus quite readily detectable by such hearing impaired person.

Figure 9:
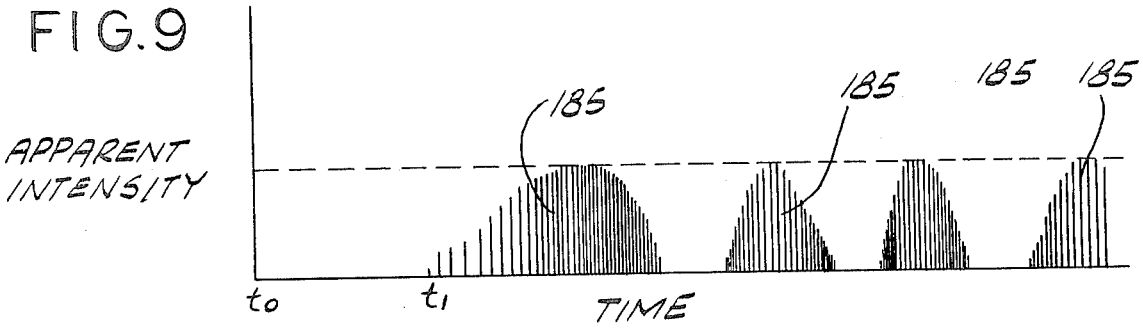
FIG. 9 is a plot of the apparent intensity of sound, as a function of time, of an audible alerting signal produced by the new circuitry as heard by a person having high frequency impaired hearing.

FIG. 9 indicates the apparent intensity of sound as a function of time by a person having high frequency impaired hearing. Beginning at time $t_1$, the person will hear the initiation of pulses of oscillation of the audible alerting system as indicated in the region 185 which increase in intensity as the device approaches a maximum hearing intensity and which intensity then falls off as the frequency of oscillation rises toward and goes beyond the upper frequency hearing limit $f_d$ of the hearing impaired person. Subsequent periods 185 follow during each of which the intensity of sound appears to rise to a maximum level and then to fall as the frequency of the audible alerting signal falls below the upper hearing limit $f_d$ of this individual to its lower limit $f_1$ and then rises again to the upper limit $f_d$ and beyond.

Therefore, it is seen that in addition to providing to a person of normal hearing a warbling, siren-like audible alerting signal which is most commanding of one's attention, the new device also provides a frequency varying, period signals which are detectable to persons having either high frequency or low frequency impaired hearing. Therefore, the new embodiment provides a persons of both normal and impaired hearing with a very noticeable and commanding audible alerting signal after a predetermined time delay following the exposure of a device of the invention to light, as where the same is placed in a medicine cabinet, tool box, drawer, or any of a myriad other closed locations which it is desired to guard by use of the new device.

As in previous embodiments, the photocell 107 of the new embodiment is preferably responsive to light in the visible portion of the spectrum, such as about 500 nanometer, so as to be responsive to various sources of light, including sunlight, fluorescent, and incandescent sources.

The specific embodiments shown and described herein are intended to be illustrative and not restrictive of the scope of the invention, it being understood that the claims are intended to encompass all variations within the range of equivalence.

What I claim and desire to obtain by Letters Patent is:

1. A portable miniaturized self-contained audible alerting apparatus for being placed in a normally darkened enclosure for audibly alerting a person outside of and a distance from said enclosure that said enclosure is opened, said apparatus comprising a small case having a light-receiving aperture, photodetector means within said case and positioned with respect to said aperture for detecting light received by said aperture and providing an electronic first signal in response to detected light, time delay means within said case, an oscillator controlled by said time delay means for providing a time-delayed electronic second signal of audible character in response to said first signal after a predetermined period following the providing of said first signal by said photodetector means continuously for said predetermined period, frequency control means within said case for causing said audible second signal to change repeatedly between upper and lower frequency limits, amplifier means within said case for effectively amplifying said time-delayed electronic second signal, and transducer means within said case for converting said electronic second signal to an audible alerting signal of sufficient loudness for being heard by said person outside of and at a distance from said enclosure, said case including within it a battery for powering said time delay means, said oscillator, said frequency control means, said amplifier means, and said transducer means, said case being positionable within said enclosure for permitting light from outside said enclosure to be received by said aperture when said enclosure is opened whereby if said enclosure is opened, said person will be alerted after said predetermined period by said audible alerting signal.

2. Apparatus as set forth in claim 1, said upper and lower frequency limits being within typically normal human hearing range, said upper limit being sufficiently high for hearing by persons having low frequency impaired hearing, said lower limit being sufficiently low for persons having high frequency impaired hearing.

3. Apparatus as set forth in claim 2, said upper and said lower limits being within the range from about 100 to 8,000 hertz.

4. Apparatus as set forth in claim 3, said upper and lower limits being about 2,500 and 800 hertz, respectively.

5. Apparatus as set forth in claim 2 and further comprising circuit means for causing said electronic signal to initially begin at a low frequency below said lower frequency limit and to rise after a predetermined time delay to said low frequency limit and thereafter to repeatedly sweep between said upper and lower frequency limits, whereby a low frequency audible warning is first given by said apparatus before said audible alerting signal.

6. Apparatus as set forth in claim 5, said low frequency being less than that capable of being heard by a person of normal hearing.

7. An apparatus as set forth in claim 1, said frequency control means comprising a second oscillator circuit adapted to provide a sweep frequency output for causing sweeping of said second signal between said upper and lower frequency limits.

8. An apparatus as set forth in claim 7, said second oscillator circuit operating at a frequency much less than the first-said oscillator circuit, said second oscillator circuit being interconnected with the first-said oscillator circuit for modulating the output frequency thereof.

9. An apparatus as set forth in claim 8, said first oscillator circuit including a resistive-capacitive network for causing the first-said oscillator circuit to have a center frequency, the first-said oscillator circuit being adapted for being modulated by a voltage provided thereto for providing an output frequency differing from said center frequency as a function of said voltage, said second oscillator circuit being adapted for providing said voltage, said voltage varying periodically in magnitude.

10. An apparatus as set forth in claim 9, said second oscillator circuit comprising a pair of logic devices interconnected by a feedback circuit for providing a square wave and further comprising means for converting said square wave to a period signal of sawtooth character having characteristically ramp-like portions.

11. An apparatus as set forth in claim 10, said time delay means comprising a resistive-capacitive circuit including a capacitor adapted for having its state of charge changed within a time delay interval, a semiconductor device for controlling change in the state of charge of said capacitor, said photodetector means comprising a photosensitive cell interconnected with said semiconductor device for causing operation in response to said detecting of light received by said aperture.

12. An apparatus as set forth in claim 11, and further comprising a further semiconductor circuit interconnected with said capacitor and adapted to cause operation of the first-said oscillator circuit in response to the voltage on said capacitor reaching a predetermined level.

* * * * *